United States Patent [19]

Voss

[11] 4,249,267

[45] Feb. 10, 1981

[54] MAGNETIC FABRIC FASTENER AND CLOSURE MEANS

[76] Inventor: Clifford C. Voss, 406 Donald Ave., Clawson, Mich. 48017

[21] Appl. No.: 72,020

[22] Filed: Sep. 4, 1979

[51] Int. Cl.[3] ..... A41D 1/06; A41B 1/10; A41F 9/02

[52] U.S. Cl. ..... 2/69; 2/121; 2/221; 2/227; 2/237; 2/234; 2/339; 24/73 MS

[58] Field of Search ..... 2/69, 69.5, DIG. 6, 2/237, 234, 339, 338, 121, 265, 221, 227; 24/73 BG, 73 MS, 73 NM

[56] References Cited

U.S. PATENT DOCUMENTS

| | | | |
|---|---|---|---|
| 2,389,298 | 11/1945 | Ellis | 24/73 MS |
| 2,389,299 | 11/1945 | Ellis | 24/73 MS |
| 2,959,832 | 11/1960 | Baermann | 24/73 MS |
| 3,034,132 | 5/1962 | Landsberger et al. | 2/69.5 |
| 3,086,529 | 4/1963 | Munz et al. | 2/DIG. 6 |
| 3,897,288 | 7/1975 | Fayling | 24/73 MS |
| 3,950,789 | 4/1976 | Konz et al. | 2/DIG. 6 |

FOREIGN PATENT DOCUMENTS

| | | | |
|---|---|---|---|
| 1374231 | 8/1964 | France | 2/DIG. 6 |

*Primary Examiner*—H. Hampton Hunter
*Attorney, Agent, or Firm*—Dale A. Winnie

[57] ABSTRACT

A fastener means for fabrics and clothing and which includes a magnetic tape material which is sewn into or otherwise applied to next adjacent edges of cloth material intended to be overlapped. Such magnetic material being relatively thin and light weight, pliable and flexible, capable of being cut to desired lengths and having the general characteristics of a narrow strip of fabric or cloth material itself.

5 Claims, 12 Drawing Figures

MAGNETIC FABRIC FASTENER AND CLOSURE MEANS

BACKGROUND OF THE INVENTION

The most commonly known and used types of fasteners for clothing and fabric materials are probably the button, snaps and hook-and-eye closures. And, where some length of closure is required or desirable, the zipper is probably the next best known and most frequently used type of fastener and closure means or device.

As used for clothing, the single fastener devices, that is the button, snap and hook-and eye types, have the disadvantage of showing a gap or opening therebetween unless they are spaced reasonably close together. This is most commonly seen, and most apparent, in shirts and dresses when the person wearing such clothing turns or bends forward or when they are overweight or their clothing is undersized. The gap or opening is caused by either stress and tension, where the fabric between fasteners is pulled in opposite directions, or become of bunching or twisting of the fabric over upon itself and where the fastener means allows for no relative adjustment.

The zipper and the newer hook-and-loop type fabric fasterners are intended and used to avoid such problems but their added expense and other inconveniences preclude their use in many instances. For example, while the zipper eliminates gaps and opening from occuring throughout its length, it allows for no lateral adjustment. And the hook-and-loop fabric fastener, while made adjustable and adaptable to variations along its length, when made in sufficient width, is not readily laundrable because of its tendency to catch and snag other fabrics and to pickup and become clogged with lint.

While some attention has been given to magnetic catches and closures for other uses, there has been little use or attention given to such means for fabrics and clothing materials.

Generally speaking, this has probably been due to the ferrous composition of magnetic materials, which can and do rust and stain fabrics when they are wet or dampened for extended period of time as would occur in laundering. Also, there have been problems of maintaining magnetic strength with inexpensive materials, the weight and bulk of the closure for the desired strength, and their relative inflexibility in the same manner as with buttons or snaps.

Consequently, magnetic materials have only been used for buttoms and ornamental purposes and then only with hand lanundered or dry cleaned garments and fabrics.

The reremains a real need for some type of simple and relatively inexpensive fastener, for fabrics and clothing, which can and will close and hold together two pieces or sides of a garment or fabric material, can be had in any length, will hold securely, while still allowing for some adjustment, will not open or gap with normal and expected use, can be readily and easily opened and/or adjusted as and where needed, and which is sufficiently light in weight, pliable and flexible for use in and with clothing garments and other fabric materials, for summer, winter or wet weather uses, and that can be laundered without any special care, attention or concern.

SUMMARY OF THE PRESENT INVENTION

This invention is directed to just such an all purpose fastener and one which is particularly designed and intended for use in clothing and wearing apparel.

The present invention makes use of a laterally and transversely pliable material, in a tape or band form, which is magnetic or has magnetic properties and characteristics.

The material is of the type made by the Industrical Electric Products Division of the 3M Company, of St. Paul, Minnesota, and is known as SCOTCH brand magnetic tape. It is a flexible polymer bonded product with barium ferrite crystals disposed and oriented in the polymer binder during manufacture to provide the desired magnetic properties. The high energy tape is then permanently magnetized with multiple north and south poles along its length to obtain a holding force of 16 ounces (1 lb.) or more per square inch.

The strong holding power of the magnetic tape material allows its use in relatively narrow widths, providing economy with exceptional performance capabilities. And, it can be bent, twisted and flexed without loss of magnetic force, made to conform to flexed and irregular surfaces, and to maintain its magnetic strength under all normal circumstances of use.

The magnitic tape is made to a desired width and may be readily cut to a selected length. Its thickness is preferably between 1/32 and $\frac{1}{8}$ of an inch, for the holding characteristics and flexibility desired.

In use it is provided within and between overlapping and sewn edges of next adjancent pieces of fabric, to hold the two together by lying over and being attracted to each other. For example, in a shirt front, a length of the pliable and flexible magnetic tape would be sewn into the two front edges, where the buttons and button holes would normally be, and they would be overlapped, causing the tapes to be attracted and hold to each other, to close the shirt front and the two sides together.

For a belt, or in a waist band, the magnetic tape would be disposed and sewn into the material lengthwise, at opposite ends, where they will overlap and be provided in respectively outer and inner disposed faces for closer engagement, where material thickness may be of some consequence.

Where desired or advisable, the magnetic tape may have an aluminum foil sheathing or cover on its outer face or side to avoid attracting metal objects, although this should seldom be of concern.

The fact that most other fastners are made of aluminum or alloy materials, that are non-magnetic, and that clothes washers and dryer tubs are of fiberglass or have plastic coatings, generally precludes any problems in using the proposed fastener means with wash and wear fabrics.

It will also be seen in the discussion which follows that the proposed fastener means has adaptation and use wherever materials are required to be sewn or fastened together. These include draperies and window curtains, where multiple panels are required, slip covers for upholstered furniture, where adjustment and fit is important for better appearance, and numerous other instances.

DESCRIPTION OF THE DRAWING FIGURES

DISCUSSION OF ILLUSTRATED AND PREFERRED EMBODIMENTS

Figure 1:
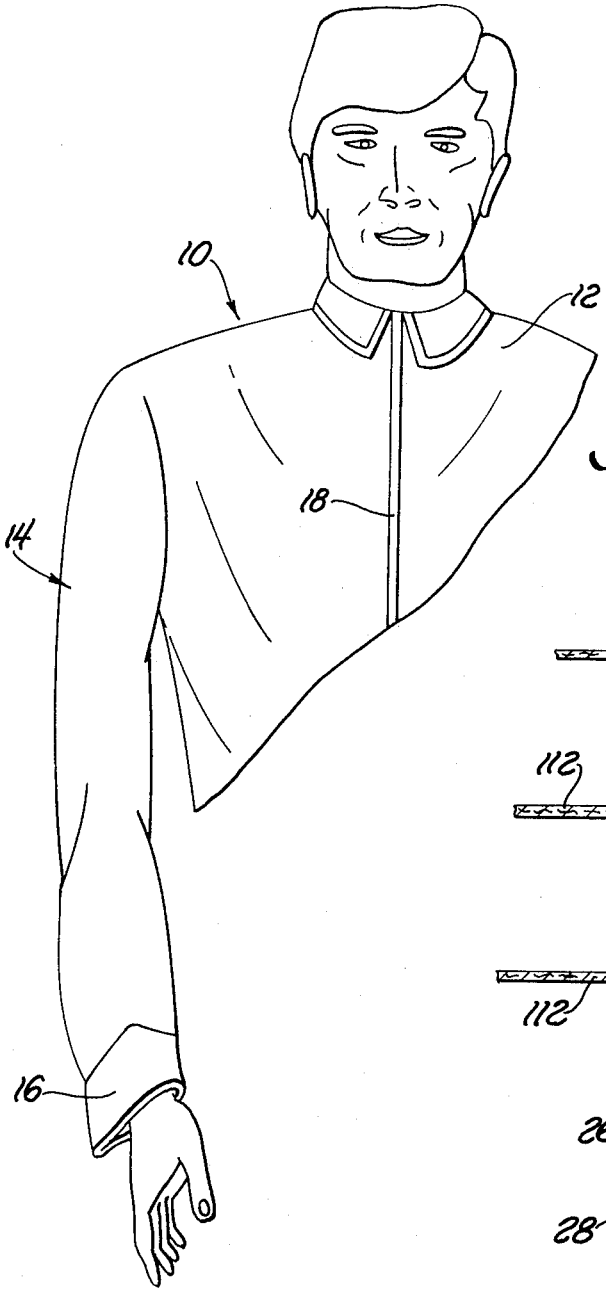
FIG. 1 is a partial upper body perspective view of a person wearing a shirt which is made and constructed in accord with the teachings of the present invention.

The person 10 shown in the first drawing figure is wearing a shirt 12 which includes the magnetic fastener means of the present invention.

The front of the shirt 12, while appearing reasonably normal, will be noted to include no button fasteners or the like down the front opening thereof. Instead, the shirt fronts are held together by the unseen fastener means of the present invention which is provided within the fabric, at the edges of the two shirt front panels, where they overlap.

Similarly the shirt sleeve 14 will be noted to have a cuff 16 which has opposite sides brought together and held by some unseen fastener means, in the style of a french cuff.

As will be hereinafter shown and described, the seam 18 down the front of the shirt 12, and the two edges of the shirt cuff 16, each include a relatively narrow, laterally pliable and longitudinally flexible magnetic tape material 20 particularly designed and intended for this particular use of holding two pieces of fabric or clothing together.

The magnetic tape material 20 is generally of the type that is made and offered by the 3M Company of St. Paul, Minnesota, for industrial uses. It is composite of flexible polymer and barrium ferrite powder that can be made in tape form to a specified width and thickness for whatever use is intended for it. The barrium ferrite is actually in crystal form and is so disposed and oriented in the polymer binder during manufacture to lend itself to being permanently magnetized and to provide multiple north and south poles along its entire length.

The ploymer material and the powder or minute crystal form of the barrium ferrite allows the composition to be made in relatively narrow, thin and long drawn out lengths. And because it can be made relatively thin, and the ploymer allows it flexibility, the product is normally rolled up and sold in a roll form of specified lengths that can be cut to shorter lengths as and when desired. Although the relative pliability and flexibility also allows the magnetic tape to be bent, twisted, and flexed, when it is made thin enough, this advantage is not fully realized in industrial uses where the tape is normally applied to a fixed surface—except to allow the tape to adjust and compensate for irregular surfaces.

Usually, the industrial form of the magnetic tape suggested is provided with a pressure sensitive adhesive backing, with a protective covering which is readily stripped off in applying a piece of the tape to a surface.

Figure 2:
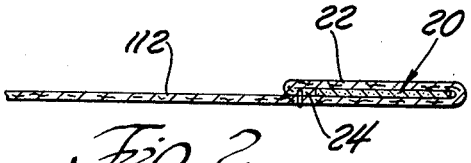
FIG. 2 is a greatly enlarged and magnified cross-sectional view of a piece of fabric having the magnetic tape of the present invention sewn into a seam at the outer edge thereof.
Figure 3:
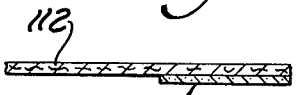
FIG. 3 is a similar cross-sectional view of another piece of fabric which has the magnetic tape of the present invention affixed to one side and near the outer edge thereof.
Figure 4:
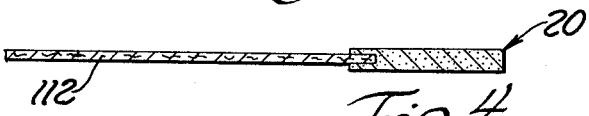
FIG. 4 is a similar cross-sectional view of still another piece of fabric which has the magnetic tape of the present invention affixed to the outer edge thereof and extending therebeyond.

FIGS. 2, 3 and 4 show cross-sectional views of the magnetic tape 20 of this invention as sewn into, adhered or affixed to a piece of fabric. Each of the views can be assumed to be one side of the shirt front 12, or of one edge of the cuff 16 and accordingly the fabric material in each drawing figure is identified as 112.

In FIG. 2 the material 112 is folded back at its outer edge and upon itself, as at 22, to cover and enclose the magnetic tape 20 therewithin. The edge is then tucked under, at 24, and sewn to the front panel, in a manner that provides the semblance of the shirt front seam 18.

The next drawing figure shows the magnetic tape 20 applied and affixed to the edge of the fabric material 112. This may be accomplished by having the tape material and the fabric material capable of being pressed or ironed together by heat sealing or adhesive means. It is also conceivable that the tape composition could be made and applied directly onto the edge of the fabric material in the course of making the shirt, or whatever.

FIG. 4 shows the magnetic tape material 20 applied or affixed to the fabric material 112 at the extreme edge and made to extend therebeyond. Here again, this construction anticipates having the polymer, for example, set up right on, over and about the edge of the fabric to which it is to be affixed.

In each of the instances shown, it will be recognized and appreciated that this is only one side of an opening that is desired to provide, and to be able to close, between two pieces or panels of a fabric material—as for example, the shirt 12. A corresponding and complimentary fabric and tape material combination is intended to be used in combination therewith. And the tape materials 20 are intended to be magnetically attracted to each other and to be magnetically engaged and held together to provide the desired closure.

While the two lengths of magnetic tape may be joined and held together face-to-face, the width of one matched to the width of the other, it will also be appreciated that they need not be fully overlapped to be engaged and held together. In other words, selected lateral adjustment is possible.

It follows, accordingly, that while the two magnetic tapes may be magnetically attracted and held together throughout their respectively overlapped length, without any opening or gap therebetween, that they need not be fully engaged but may be more or less overlapping while still maintaining such engagement and closure. And, they may also be separated and left open at one end, as for a collar opening.

Figure 5:
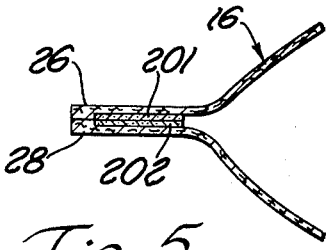
FIG. 5 is a partial cross-section through a shirt cuff, of the type shown in the first drawing figure, to show use of the present invention in a "french cuff" adapatation.
Figure 6:
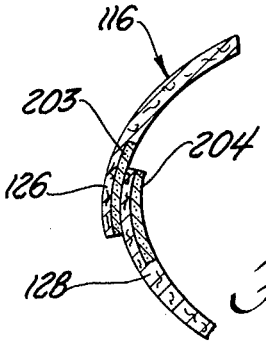
FIG. 6 is similar to the preceding drawing figure, showing a "barrel cuff" adaptation.

FIG. 5 shows the shirt sleeve cuff 16 with the two open edges of the cuff 26 and 28 having short pieces of magnetic tape 201 and 202 provided thereon in a manner which will allow them to be engaged and held together as shown. At the same time, FIG. 6 shows a like or similar shirt cuff arrangement 116 with the cuff edges 126 and 128 disposed to overlap, as with a barrel cuff, and to still be magnetically attracted and engaged together by the sections of magnetic tape, here identified as 203 and 204.

It will be noted that in the barrel cuff arrangement of the last mentioned drawing figure that the two sections of magnetic tape are not exactly aligned. Also, it will be noted that the attraction between the two magnetic tapes is through the fabric material of the shirt sleeve cuff.

The magnetic tape for this ivention is preferably made to a thickness of between 1/32 and $\frac{1}{8}$ of an inch to obtain the holding characteristics desired and still have the degree of flexibility that is most beneficial. And, in such range of thickness, attraction through shirt fabric is well within the acceptable range for use as herein proposed.

Figure 7:
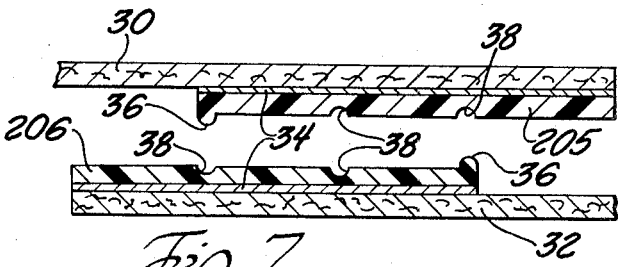
FIG. 7 is a still further magnified cross-section of two pieces of fabric with the magnetic tape fastener means of the present invention and with certain detail features of further note.

Referring now to FIG. 7, here is shown a further modification, adaptation or species of the present invention wherein the two lengths of magnetic tape 205 and 206 are provided on cooperating edges 30 and 32 of a fabric material and have an aluminum foil or like backing 34. This, as will be appreciated, is to serve as a protective shield on the outside of the magnetic tape so that the magnetism will not attract unwanted articles, such as pins, paper clips, or the like. While this is not viewed as a necessary alternative, it is mentioned as a conceivable solution to a foreseeable problem with more expensive and high fashion garments where even the remote possibility of such an occurance might be objectionable.

This particular drawing figure also shows the magnetic tapes made with an inner lip or ridge 36 along with their respectively opposite edges and which allow for some fixed lateral adjustment between the two fastner means.

For example, with the two tapes matched up, face-to-face, each of the lips or ridges would extend beyond the free edge of the other tape and lateral adjustment outwardly from each other would still be possible, in the manner heretofor explained. However, aligned as shown the lower disposed lip or ridge is aligned with one of the two grooves 38 in the upper disposed tape, and the upper disposed lip or ridge on the other tape is relatively aligned for engagement in one of the two grooves 38 in the lower disposed tape. Consequently, when the two tapes are brought together and held magnetically, they are relatively fixed and precluded from further lateral adjustment. This is, except to dispose the lips or ridges 36 in the other grooves 38.

Figure 8:
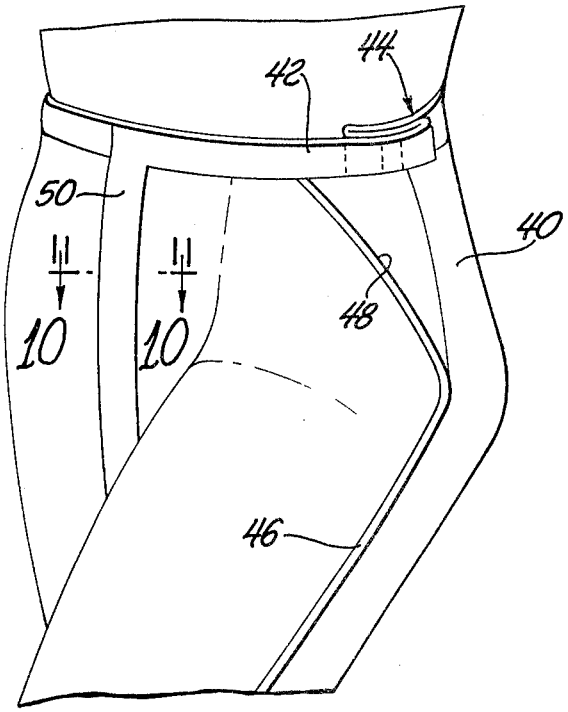
FIG. 8 is a partial lower body view of a person wearing slacks or trousers which are made and constructed in accord with the teachings of the present invention.
Figure 9:
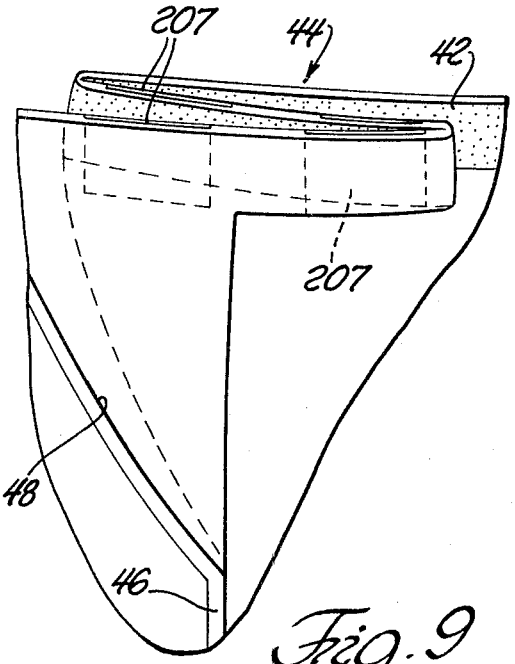
FIG. 9 is an enlarged detail view of the waist line of the trousers shown in the preceding figure, showing an adjustment and closing thereof.
Figure 10:
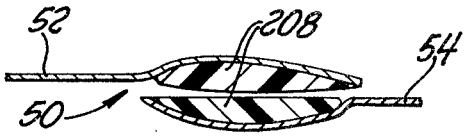
FIG. 10 is an enlarged cross-sectional detail taken in the plane of 10—10 in the preceding drawing figure showing the closure adaptation in such area.

FIGS. 8 and 9 show the magnetic tape closure and fastener means of the present invention as used with a pair of pants or trousers 40.

The pants or trousers 40 are shown to include a waist band 42 with adjustable means 44 at each side, at the out seam 46, and just over the pockets 48. There is also a front or fly closure 50 with a magnetic closure, as will be hereinafter described.

The waist band adjustment is best shown in FIG. 9 to include short lengths of magnetic tape 207 which are sewn or otherwise provided on or in the waist band in a manner to allow overlapping adjustment and cooperation.

Similarly, the front of the trousers 40 have lengths of molded magnetic tape 208 within each of the fly opening edges 52 and 53 to assure a proper closure in this area.

Figure 11:
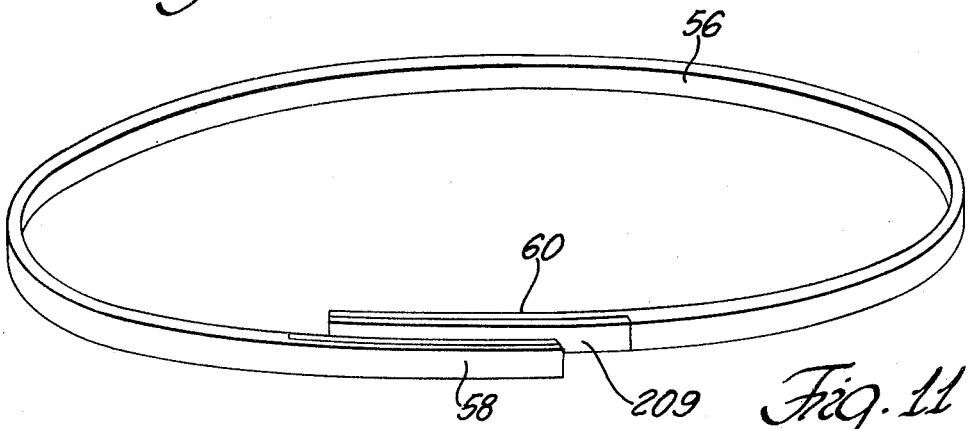
FIG. 11 is a perspective view of a belt with the magnetic fastener means of the present invention embodied therewithin.
Figure 12:
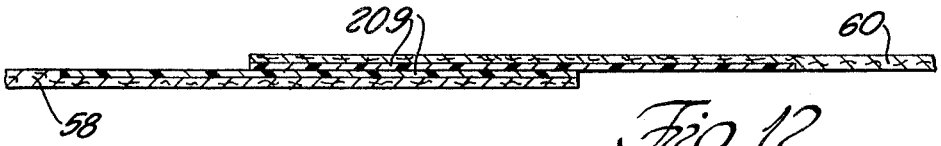
FIG. 12 is an enlarged cross-sectional view showing the overlapping ends of the belt in the previous drawing figure and the magnetic fastner means used therewith.

FIGS. 11 and 12 show a simple form of belt 56 with the opposite ends 58 and 60 each having a length of magnetic tape 209 provided on the inner faces thereof for relative engagement. As is shown and will be appreciated, the tape extends back from each end of the belt to allow for reasonable adjustment and different sizes. Within a leather or simulated leather belt, the tapes could be inset and made a decorative part of the belt.

It follows that wherever in the preceding description the use of color, size or shape other than is shown, would be condusive to accomplishing the objectives sought that such variations and modifications would be used.

Similarly, while this specification has been on the use and adaptation of the magnetic tape fastener and closure means to clothing apparel, any and all other fabric, cloth and like pliable materials that can make use of this type fastener and/or closure are likewise envisioned and intended to be covered and included within the hereinafter appended claims. Only such language as specifically excludes by normal and acceptable usage shall be viewed or taken as a limitation upon the claims.

I claim:

1. Fastener means for fabric and like materials, and comprising:

a relatively thin, pliable, light-weight polymer material, roll formed and provided in selected lengths and widths, being normally flat and plane surfaced, and of a composition capable of being permanently magnetized and having magnetic properties for relative attraction and holding engagement with other like and comparable materials similarly formed and provided, said material being of itself so formed, flexible and pliable as to allow overlapping engagement and attraction to next adjacent similar material and for selective progressive separation of said materials from each other beginning at a given end thereof, and means for providing said materials on fabrics and cloths along cooperating edges thereof to form and provide an operable closure therebetween.

2. The fastener means of claim 1, said materials having cooperating ridges and depressions extending the full length thereof for relative lateral orientation of one to the other as disposed and engaged directly together.

3. The fastener means of claim 1, said last mentioned means including having said fabrics and cloths folded back over and enclosing said magnetic materials therewithin.

4. The fastener means of claim 3, said magnetic materials, enclosed within fabrics and cloths, being provided with a surface texture that is resistive to relative lateral movement therebetween.

5. The fastener means of claim 1, said last mentioned means including having said magnetic materials being of a composition capable of being directly applied to fabrics and cloths in a fluid state, for impregnating the fibers thereof, and subsequently setting-up to a dry, usable state.

* * * * *